United States Patent [19]

Ferguson et al.

[11] Patent Number: 5,046,336

[45] Date of Patent: Sep. 10, 1991

[54] BATTERY POWERED DISPENSER

[75] Inventors: Christopher Ferguson, Framingham; Joseph R. Adamski, Sudbury, both of Mass.

[73] Assignee: Raytheon Company, Lexington, Mass.

[21] Appl. No.: 610,740

[22] Filed: Nov. 9, 1990

Related U.S. Application Data

[63] Continuation of Ser. No. 458,109, Dec. 28, 1989, abandoned.

[51] Int. Cl.[5] ..... D06F 39/02

[52] U.S. Cl. ..... 68/17 R; 222/651

[58] Field of Search ..... 68/17 R, 207; 134/93, 134/99, 100, 101; 222/333, 648, 651, 652

[56] References Cited

U.S. PATENT DOCUMENTS

| | | | |
|---|---|---|---|
| 3,289,886 | 12/1966 | Goldsholl et al. | 222/648 X |
| 3,931,914 | 1/1976 | Hosaka et al. | 222/333 X |
| 4,296,768 | 10/1981 | Saucedo | 134/57 DL X |
| 4,393,993 | 7/1983 | Kille et al. | 222/333 X |

FOREIGN PATENT DOCUMENTS

| | | | |
|---|---|---|---|
| 2214524 | 9/1989 | United Kingdom | 68/17 R |

*Primary Examiner*—Philip R. Coe

*Attorney, Agent, or Firm*—William R. Clark; Richard M. Sharkansky

[57] ABSTRACT

A clothes washing machine including a cabinet having therein a spin tub rotatably disposed within a stationary drain tub, and an additive liquid dispensing system comprised of a multi-load reservoir of additive liquid connected hydraulically through a pump to a liquid ejector nozzle. The pump preferably comprises a constant displacement pump coupled to an electrical drive motor for drawing additive liquid from the reservoir and expelling it from the nozzle at a uniform rate of flow. The motor is connected electrically through a control unit to a rechargeable battery which is connected electrically to the output of a trickle charge transformer unit. The control unit includes an adjustable element disposed for preselecting the quantity of additive liquid to be injected into the wash load, and an electrical timer element energized from the battery for activating the motor a length of time corresponding to the quantity of additive liquid selected. The nozzle preferably is disposed adjacent an opening in the spin tub for directing therein the additive liquid expelled from the nozzle.

7 Claims, 2 Drawing Sheets

BATTERY POWERED DISPENSER

This application is a continuation of application Ser. No. 458,109 filed Dec. 28, 1989, and now abandoned.

BACKGROUND OF THE INVENTION

1. Field of the Invention

This invention relates generally to automatic washing machines and is concerned more particularly with an automatic clothes washing machine having an additive fluid dispenser system powered by a source of direct current.

2. Discussion of the Prior Art

In the loading of an automatic washing machine, clothes generally are deposited through an access door into an open end of a perforated spin tub which is rotatably supported in a stationary drain tub within a cabinet. The washing machine may be cycled through a sequence of operations including a presoaking operation followed by a first liquid extraction, a washing operation followed by a second liquid extraction, a rinsing operation followed by a third liquid extraction, and a spin drying operation. For any of these operations, an additive fluid may be injected into the wash load to enhance the results of the associated operation.

Consequently, there has been developed in the prior art a number of additive dispensing means having respective housings disposed for holding additive liquids until released for a particular operation of the wash cycle. For example, in a patent application filed concurrently herewith by R. L. Bisplinghoff, et. al and assigned to the same assignee, there is disclosed an additive fluid dispensing means comprising a multi-load reservoir of additive liquid connected through a pumping means to a stream ejecting nozzle. The additive liquid may comprise a conventional liquid soap having a viscosity which varies over a wide range of temperatures. Also, the pumping means includes a constant displacement pump, such as a vane type pump, for example, which is driven by an electrical motor.

For the described fluid dispensing means, the motor driving the pump usually is of the alternating current type because of the simplicity in design resulting from having the motor energized from the same alternating current source used for operating the washing machine. However, the advantages, thus gained, may be outweighed by the comparatively large size of the alternating current motor required for delivering the torque necessary to pump high viscosity liquids, such as relatively cold liquid soap, for example. An alternating current motor of this comparatively large size may be regarded as unduly expensive in view of the task it performs, namely, driving a constant displacement pump so that additive liquids with temperature sensitive viscosities may be injected at a uniform rate into a spin tub of a washing machine.

In selecting the type of electrical motor best suited for the described fluid dispensing means, one factor that should be taken into consideration is the relatively short duty cycle of the motor. It is expected that the motor will be energized to drive the pump for only a brief period of time, such as about thirty seconds, for example. This period of time should be sufficient for injecting an adequate quantity of additive liquid, such as soap, for example, into a spin tub for processing a single wash load.

Another factor that should be taken into consideration when selecting the motor for driving the additive pump is the life expectancy of the motor. It is anticipated that the washing machine will be used for processing a wash load on the average of eight times a week over a period of about eleven years. Thus, the life expectance of the motor is approximately thirty-eight hours of operation.

Therefore, in view of the relatively short duty cycle and life expectancy of the motor driving the pump, it may be argured that the alternating current motor of comparatively large size mentioned above is not the most cost-effective mean for performing the described function.

SUMMARY OF THE INVENTION

These and other disadvantages of the prior art are overcome by this invention providing a clothes washing machine with a cabinet having therein a fluid dispensing system powered by a source of direct current. The fluid dispensing system includes a reservoir of additive liquid connected hydraulically to a liquid ejector through a pumping means for withdrawing additive liquid from the reservoir and expelling it from the liquid ejector. The pumping means includes a pump coupled to a direct current motor which is connected electrically through a control means to the source of direct current.

The source of direct current preferably comprises a rechargeable battery which is connected to a trickle charge transformer means for storing energy in the battery to supply the motor with a pulse of direct current sufficient to drive the pump a required interval of time for dispensing the desired amount of additive liquid. The pump preferably is a constant displacement pump, such as a vane type pump, for example, which withdraws additive liquid from the reservoir and expels it forcefully from the liquid ejector at a uniform rate. Consequently, the time interval that the pump is operated corresponds to the amount of additive liquid expelled from the liquid ejector. Accordingly, the electrical control means includes an electrical timer unit for determining the length of time the constant displacement pump will be driven by the direct current motor. Also, the electrical control means is connected to an additive selector means for selecting the quantity of additive liquid to be expelled from the liquid ejector.

The liquid ejector preferably comprises a nozzle disposed adjacent an open end of a spin tub in the cabinet for directing a stream of the expelled additive liquid into the spin tub. Also, the reservoir preferably is of the multi-load type for holding a sufficient quantity of the additive liquid to supply a plurality of successive wash loads with respective injections of the additive liquid.

BRIEF DESCRIPTION OF THE DRAWINGS

For a better understanding of this invention, reference is made in the following detailed description to the accompanying drawings wherein.

DESCRIPTION OF THE PREFERRED EMBODIMENT

Figure 1:
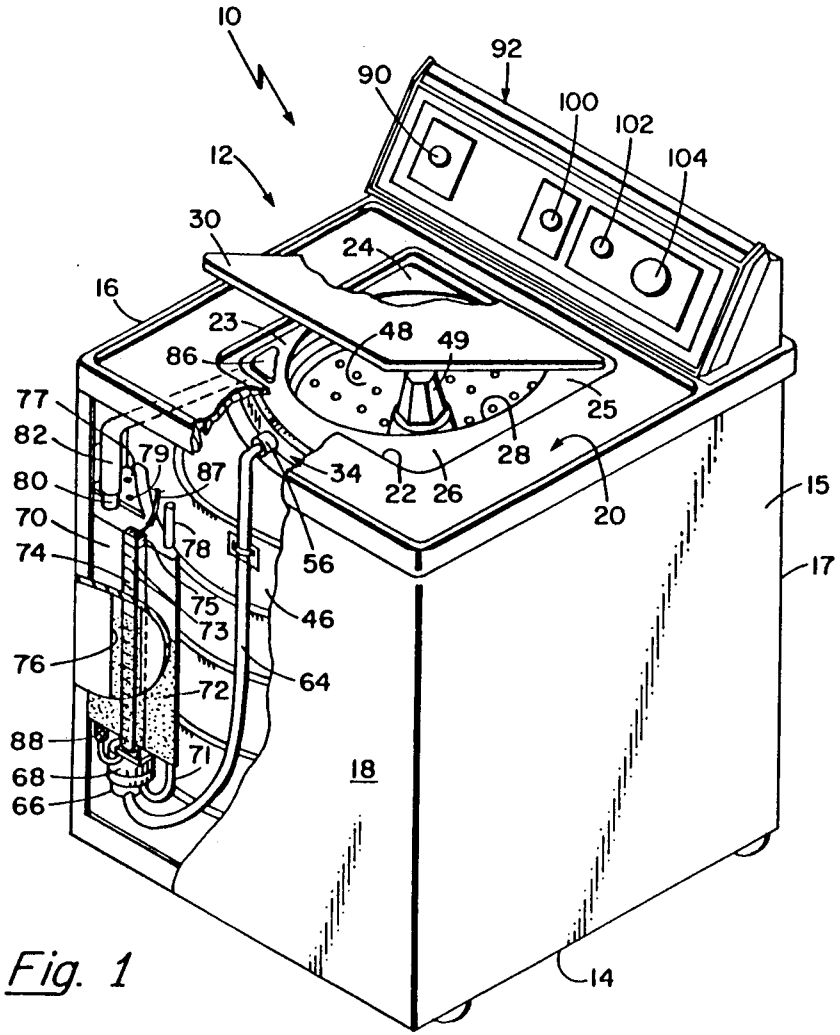
FIG. 1 is an isometric view, partly in section, of a clothes washing machine embodying the invention.

Referring to the drawings wherein like characters of reference designate like parts, there is shown in FIG. 1 an automatic clothes washing machine 10 of the vertical axis rotatable type having an upright cabinet 12 made of suitable metallic material, such as stainless steel sheet metal, for example. The cabinet 12 may be provided with a generally hexahedral configuration and a substantially rectangular cross-section. Cabinet 12 may include a base end wall 14, opposing side walls 15 and 16, respectively, a rear wall 17 and an opposing front wall 18. Also, the cabinet 12 is provided with a top or access end wall 20 having therein a generally rectangular recess 22 which includes four corner portions 23, 24, 25 and 26, respectively. The respective corner portions 23–26 aid in defining a circular clothes receiving opening 28 centrally disposed in the recess 22, and in supporting a hinged door 30 in a closed position within the recess 22. Door 30 may be moved pivotally to a fully open position when access to the clothes receiving opening 28 is required, such as when depositing clothes (not shown) in the clothes receiving opening 28 or when removing a wash load (not shown) from the machine 10, for example.

Figure 2:
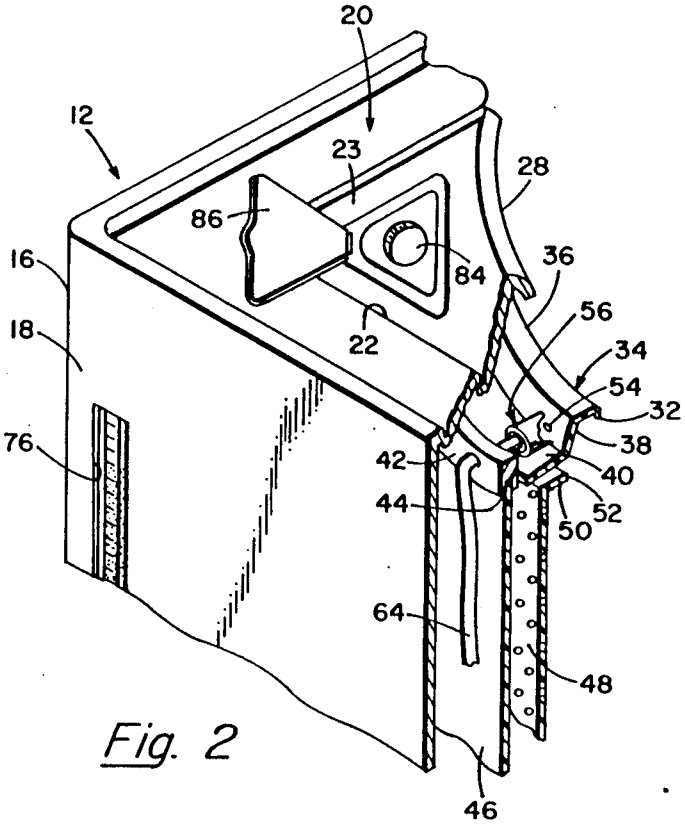
FIG. 2 is an enlarged fragmentary view of a portion of the washing machine shown in FIG. 1 and having therein the nozzle of this invention.

As shown more clearly in FIG. 2, the clothes receiving opening 28 is defined by an inner peripheral portion of access end wall 20 in recess 22 being curved axially inward of cabinet 12. This inner peripheral portion of access end wall 20 is encircled by a spaced lip 32 of an annular cowling 34 which is made of molded plastic material, such as a polycarbonate material, for example. The inner periphery of lip 32 defines a cowling opening 36 which has a diameter larger than the diameter of clothes receiving opening 28. Lip 32 has an outer peripheral portion which is integrally joined to a small diameter end of a frusto-conical element 38 of the cowling 34. Frusto-conical element 38 has a large diameter end portion integrally joined to an inner periphery of a annular channel element 40 of cowling 34. From its inner periphery, channel element 40 slopes radially at a divergent angle with the plane of access end wall 20, and terminates at its outer periphery in an integral flange element 42. The flange element 42 extends axially and comprises the outer peripheral portion of cowling 34.

Figure 4:
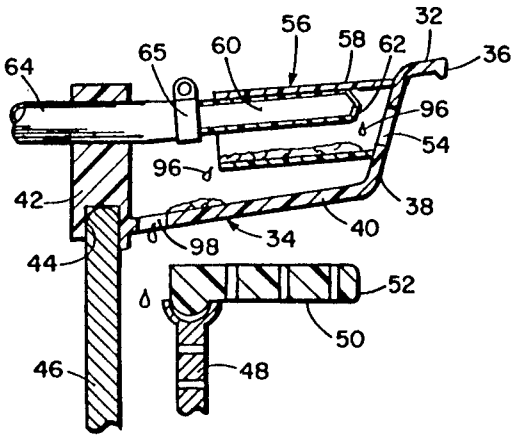
FIG. 4 is an enlarged schematic sectional view of the nozzle shown in FIG. 2 while directing excess droplets of additive liquid away from the spin tub.
Figure 3:
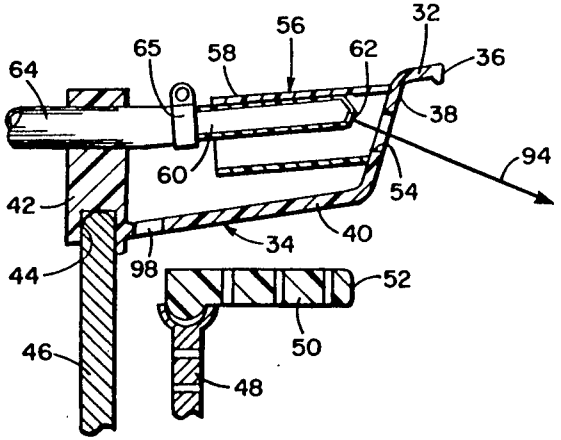
FIG. 3 is an enlarged schematic sectional view of the nozzle shown in FIG. 2 while directing a stream of additive liquid into the spin tub.

As shown more clearly in FIGS. 3 and 4, there is disposed in a lower end portion of flange element 42 an axially extending groove 44 wherein a circular rim portion of a stationary drain tub 46 is snugly received. Drain tub 46 is of the conventional type made of rigid material, such as stainless steel, for example. The circular rim portion of drain tub 46 defines an open end thereof disposed in a plane adjacent wall 20 and supports in cantilever fashion the annular cowling 34 which extends radially inward from the rim portion of drain tub 46. Also, the circular rim portion of drain tub 46 terminates an axially extending, imperforated wall thereof which is spaced radially outward of an axially extending, perforated wall of a spin tub 48.

The spin tub 48 is of the conventional type supported for axial rotation within the drain tub 46 and made of suitable material, such as porcellainized stainless steel, for example. Extending axially within the spin tub 48 is a conventional agitator post 49 which is disposed for rotation with the spin tub 48. Agitator post 49 has a distal end disposed adjacent an open end of the spin tub 48, which is defined by a bifurcated rim portion thereof. Pressed into the bifurcated rim portion of spin tub 48 is a dimpled under portion of a conventional spin tub collar 50 which may be perforated similar to the axially extending wall of spin tub 48. Collar 50 is made of suitable plastic material, such as a polycarbonate material, for example, and extends in cantilever fashion radially inward from the bifurcated rim portion of spin tub 48. The collar 50 has an inner periphery defining a collar opening 52 which has a diameter larger than the diameter of cowling opening 36 and is generally aligned therewith. Thus, when clothes (not shown) are deposited in the clothes receiving opening 28, they pass through the aligned cowling opening 36 and collar opening 52 to land in the spin tub 48 for processing by the machine 10.

The frusto-conical element 38 has extended through a portion thereof adjacent the front wall 18 of cabinet 12 a target aperture 54 through which a portion of the collar opening 52 may be viewed. Encircling the target aperture 54 is an outer surface portion of frusto-conical element 38 having attached thereto one end of a cylindrical nozzle 56 which is made of molded plastic material, such as a polycarbonate material, for example. The nozzle 56 extends in cantilever fashion outwardly from the frusto-conical element 38 and is supported in spaced relationship with the channel element 40 of cowling 34. Nozzle 56 comprises a drain tube component 58 having eccentrically disposed therein a longitudinally extending delivery tube component 60 with an outer diameter substantially smaller than the inner diameter of drain tube component 58. The drain tube component 58 has an open spout end which is attached, as by bonding with epoxy adhesive, for example, to a surface portion of frusto-conical element 38 encircling target aperture 54. Also, the drain tube component 58 has an opposing drain end portion which is open and has extended longitudinally therein the smaller diameter delivery tube component 60.

The delivery tube component 60 is disposed longitudinally within the drain tube component 58 and is attached, as by bonding with epoxy adhesive, for example, to an inner surface portion of the drain tube component 58. As a result, the delivery tube component 60 is eccentrically disposed with respect to the axial centerline of drain tube component 58. Delivery tube component 60 has a spout end portion which is conically shaped and is recessed axially within the spout end portion of drain tube component 58. The spout end portion of delivery tube component 60 has extended through a sloped wall portion thereof aligned with target aperture 54 an outlet orifice 62 which is disposed for directing a stream of additive liquid through the target aperture 54. Delivery tube component 60 has an opposing input end portion extended longitudinally out of the drain end portion of the drain tube component 58 and connected hydraulically to an adjacent end portion of a flexible hose 64. The hose 64 is made of suitable material, such as polyethylene, for example, and is connected to the input portion of delivery tube component 60 in a conventional liquid-tight manner, such as by use of an encircling hose clamp 65, for example.

The flexible hose 64 extends downwardly within cabinet 12 and along the front wall 18 thereof to an end portion of hose 64 which is connected hydraulically to an output port of an additive pump 66 in a conventional liquid-tight manner. Pump 66 may be of the rotary vane type which is rotatably coupled to an additive motor 68, such as a pump and an alternating current motor combination sold by Sandek Charger Services of National Charger Service Center in Alexandria, Va., for example. The vane type pump 66 comprises a central hub having extending radially therefrom a circular array of angularly spaced vanes which are made of suitably rigid material, such as steel, for example. Pump 66 is supported by the motor 68 which is attached by suitable means to a lower plate-like end of an elongated reservoir housing 70. Preferably, the housing 70 is provided with a generally triangular cross-section for fitting conveniently in an elongated corner portion of cabinet 12 defined by a juncture of front and side walls, 18 and 16, respectively, of the cabinet. Housing 70 may be made as a single integral unit from soap resistant material, such as molded plastic material, for example, and has a hollow interior connected hydraulically through a flexible hose 71 to an input port of the pump 66. The housing 70 has a volumetric capacity for containing a multi-load quantity of liquid soap 72, such as one gallon or fifteen cups, for example, whereby successive loads of washing may be processed by the machine 10 over an extended period of time, such as one month, for example, without requiring refilling of the housing 70.

Adjacent the front wall of cabinet 12, the housing 70 has a side surface from which protrudes a colinear length of clear plastic tubing 74 having a generally rectangular cross-section. The tubing 74 is sealed to the adjacent side surface of housing 70 and communicates with the interior of housing 70 all along the length of tubing 74. Consequently, there is disposed in tubing 74 a column of the liquid soap 72 which indicates the level reached by the quantity of liquid soap 72 in housing 70. Disposed in the front wall 18 of cabinet 12 and aligned with the tubing 74 is a window 76 made of transparent material, such as clear plastic material, for example, whereby the level of soap 72 in housing 70 may be ascertained from externally of machine 10.

Also, the side of tubing 74 adjacent window 76 may be provided with a colinear series of uniformly spaced graduations 73 which correspond to respective cups of liquid soap 72 in the housing 70. Thus, the graduations 73 provide means for readily determining the total quantity of liquid soap 72 remaining in the housing 72. Moreover, the upper end surface of tubing 74 may have secured thereto in a conventional manner a light radiating means 75 which is connected electrically through a conductor cable 87 to a source of electrical power (not shown), such as a conventional alternating current source utilized for operating the washing machine 10, for example. The light radiating means 75 may comprise an inverted electrical socket (not shown) having therein an electrical lamp (not shown) which is disposed for directing light longitudinally down into the tubing 74. As a first alternative, the light radiating means 75 may comprise one or more light emitting diodes disposed to direct light down into the tubing 74. As a second alternative, the light radiating means 75 may comprise a tubular fluorescent light extending longitudinally parallel with the tubing 74. Furthermore, the opposing longitudinal sides of tubing 74 may be silvered to reflect light back onto the liquid soap 72 in tubing 74. Accordingly, the light radiating means 75 functions to illuminate the level of liquid soap 72 in tubing 74 so that the quantity of soap 72 remaining in housing 70 may be readily ascertained even in poorly illuminated environments.

The housing 70 includes an upper plate-like end which is attached by suitable means, such as right-angled plate 77 and screws 79, for example, to the side wall 16 of cabinet 12. Protruding from the upper end of housing 70 is a vent tube 78 which communicates with the interior of housing 70 for permitting egress and ingress of air as the level of liquid soap 72 increases and decreases, respectively, within housing 70. Also, the upper end of housing 70 has protruding therefrom a filler tube 80 which communicates with the interior of housing 70 and is connected hydraulically to one end portion of a filler hose 82. The filler hose 82 extends from the filler tube 80 upwardly within cabinet 12 and has its other end portion connected in a liquid-tight manner to a filler port 84 (FIG. 2). Filler port 84 is disposed in corner portion 23 of access end wall 20 within recess 22, and is provided with a protective cover 86 which is hinged. Thus, the cover 86 may be moved pivotally to a fully open position for pouring liquid soap 72 through the filler port 80 and filler hose 82 into the reservoir housing 70. Then, the cover 86 may be moved pivotally to a fully closed position where it may remain for the extended period of time, such as one month, for example, required to exhaust the contents of reservoir housing 70.

The additive motor 68 is connected through an electrical cable 88 to a soap dispensing control means comprised of a rotatable knob 90 protruding from a control panel 92 which extends upwardly from a marginal portion of access end wall 20 adjacent rear wall 17 of cabinet 12. Knob 90 may be maintained at a zero rotational position and pressed axially inward toward panel 92 for electrically energizing motor 68 and activating pump 66 as long as the knob 90 is pressed inwardly toward panel 92. Alternatively, the knob 90 may be rotated, such as ninety degrees from the zero rotational positions, for example, to select a predetermined quantity of additive liquid soap 72, such as one-quarter of a cup, for example. Then, the knob 90 may be pressed inwardly toward panel 92 and released to energize motor 68 and activate pump 66 for a predetermined length of time. In either instance, when the pump 66 is activated, liquid soap 72 is drawn from the reservoir housing 70 through hose 71 and forced through the hose 64 to the delivery tube component 60 of nozzle 56.

Figure 5:
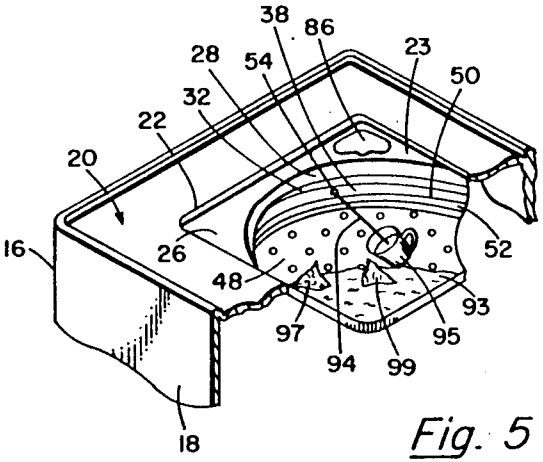
FIG. 5 is a fragmentary isometric view of the washing machine shown in FIG. 1 during operation of the invention.

Consequently, as shown in FIG. 3, the pumped liquid soap 72 emerges from the outlet orifice 62 as a jet stream 94 which passes through the target aperture 54. As a result, the jet stream 94 of liquid soap is directed through the opening 52 of collar 50 and enters the spin tub 48. As shown in FIG. 5, a cup 95 may be held in the path of the jet stream 94 to determine if the quantity of liquid soap 72 being directed into spin tub 48 corresponds to the quantity of liquid soap 72 selected by adjustment of knob 90. Also, the liquid soap, thus obtained, may be examined regarding its quality and concentration for producing the desired effect on the wash water in spin tub 48. Preferably, the jet stream 94 entering spin tub 48 impinges on the agitator post 49 so that the liquid soap 72 in jet stream 94 will flow slowly down the post 48 and mix gradually with the wash water in spin tub 48. The stream 94 of liquid soap may be directed into spin tub 48 when wash water 93 is entering from drain tub 46 in the conventional manner and beginning to rise in the spin tub 48. Alternatively, the stream 94 of liquid soap may be directed into spin tub 48 when the wash water 93 has reached, or nearly reached, the required level in spin tub 48 for processing a wash load comprising items of clothing, such as 97 and 99, for examples, which have been passed through the clothes receiving opening 28 and are immersed in the wash water 93.

As shown in FIG. 4, when the motor 68 is de-energized and the pump 66 de-activated, the jet stream 94 no longer emerges from the outlet orifice 62. However, droplets 96 of liquid soap continue to accumulate at the outlet orifice 62 and fall into the drain tube component 58 of nozzle 56. Due to the slope of drain tube component 58, the droplets 96 run along the drain tube component 58 toward the drain end thereof which is adjacent the flange element 42 of cowling 34. As a result, the droplets 96 run out of the open drain end of drain tube component 58 and fall onto the underlying channel element 40 of cowling 34. Since the channel element 40 has a slope similar to the slope of drain tube component 58, the droplets 96 run radially downward of the channel element 40 to the junction thereof with the flange element 42 of cowling 34. Extended through a marginal portion of channel element 40 adjacent the flange element 42 is a plurality of arcuately spaced drain holes 98. Consequently, the drain holes 98 communicate with the radial space between the axially extending, imperforated wall of drain tub 46 and the axially extending perforated wall of spin tub 48. Accordingly, the droplets 96 pass through one or more of the drain holes 98 and fall into the wash water in the portion of drain tub 46 outside of the spin tub 48. Thus, the droplets 96 eventually mix with the portion of the wash water passing through the perforated wall of spin tub 48 and entering the spin tub 48.

Referring again to FIG. 1, the control panel 92 having protruding therefrom soap dispenser control knob 90 similarly may be provided with a water level control knob 100, a water temperature control knob 102, and a mode selector knob 104. The respective knobs 100, 102 and 104 electrically control the automatic operation of a plurality of components within cabinet 12 which are not shown since they do not affect the operation of the disclosed soap dispenser system. However, the mode selector knob 104 may be rotated to a position requiring the machine 10 to pass automatically through a presoaking operation prior to commencing a washing operation where injection of the liquid soap 72 into spin tub 48 is desired. Therefore, in order to retain automatic operation of the machine 10, it may be considered advantageous to incorporate electrical control of the soap dispenser system into the electrical control circuitry operated by the mode selector knob 104. Then, when the pre-soaking and subsequent water extraction operations are completed, the soap dispenser system will be activated simultaneously with the machine 10 commencing a washing operation. Thus, the disclosed soap dispenser system may be activated by manually pressing the knob 90 inwardly toward panel 92 or by automatically energizing the soap dispenser system electrically from the circuitry controlled via movement of the mode selector knob 104.

Figure 6:
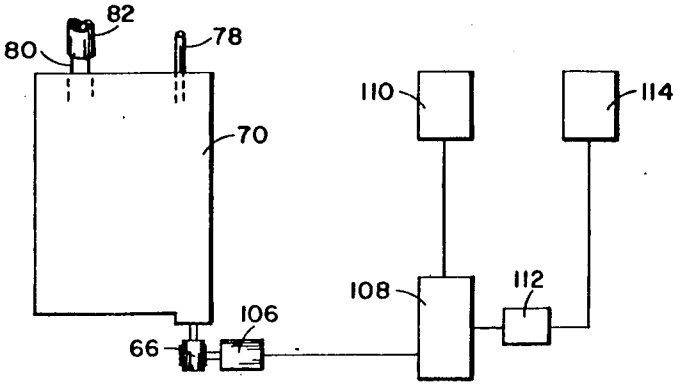
FIG. 6 is a schematic view of an alternative means for powering the additive liquid dispensing system shown in FIG. 1.

As shown in FIG. 6, the pump 66 instead of being coupled to the alternating current motor 68 shown in FIG. 1 may be coupled to a comparatively smaller direct current motor 106 which delivers an equivalent amount of power, such as thirty watts, for example, for forcing the liquid soap 72 through the outlet orifice 62. The direct current motor 106 may be especially designed for operating efficiently the pump 66 during the relatively short duty cycles, such as thirty seconds, for example, and life expectancy, such as forty hours, for example, expected of the motor. Direct current motors of this type may be found in battery powered tools, such as cordless drills and screwdrivers, for examples, which have similar torque requirements.

Pump 66 preferably is of the constant displacement type, such as a vane type having rigid vanes, for example, which forcefully expels liquid soap 72 from the nozzle 56 at a uniform rate. The direct current motor 106 is connected electrically to a control means comprising a conventional type of electrical timer circuit 108 and a dispenser amount selector unit 110. The selector unit 110 functions through the electrical timer circuit 108 to determine the length of time the motor 106 is energized thereby metering the amount of liquid soap 62 expelled from the nozzle 56. The electrical timer circuit 108, which generally includes integrated circuit devices (not shown) is energized, along with the direct current motor 68, from an electrically connected battery 112. Battery 112 is of the rechargeable type and is connected electrically to a trickle charge transformer 114 which may have its input connected electrically to the source of alternating current used for operating the washing machine 10.

Accordingly, there has been disclosed herein a soap dispenser means including reservoir housing 70 having an interior provided with a capacity for containing a multi-load quantity of liquid soap 72, and connected through pump 66 to the cylindrical nozzle 56. The nozzle 56 comprises delivery tube component 60 disposed longitudinally and eccentrically in outer drain tube component 58 which has an open spout end portion and an opposing open drain end portion. The delivery tube component 60 has an input end portion connected hydraulically to the pump 66 and has an opposing spout end portion which is conically shaped and recessed axially within the spout end portion of drain tube component 60. The spout end portion of delivery tube 60 has extended through a sloped wall portion thereof outlet orifice 62 which is disposed for directing the jet stream 94 of liquid soap from pump 66 out of the spout end portion of drain tube component 58.

The spout end portion of drain tube component 58 is secured in encircling relationship with the target aperture 54 in cowling 34 such that the drain tube component 58 slopes downwardly from its spout end portion to its drain end portion. Also, the drain tube component 58 extends radially over the annular channel element 40 of cowling 34 which has a slope in the radial direction similar to the slope of drain tube component 58. The jet stream 94 emerging from the spout end portion of drain tube component 58 is directed through the target aperture 54 in cowling 34 and into spin tub 48 of machine 10. The opening of spin tub 48 is aligned with a clothes receiving opening 28 of machine 10 which is encircled by the cowling 34. Consequently, the nozzle 56 which is supported on the cowling 34 outside the periphery of clothes receiving opening 28 does not snag or otherwise interfere with clothing passed through the clothes receiving aperture 28.

When the jet stream 94 ceases, any droplets 96 of liquid soap falling from the outlet orifice 62 land in the spout end portion of drain tube component 58. Due to gravity, the falling droplets 96 run down the slope of drain tube component 58 and out the open drain end portion thereof. Also, due to gravity, the droplets 96 landing on the channel element 40 run radially down the slope thereof and pass through one or more of the drain holes 98 to mix harmlessly with the wash water between the respective axially extending walls of drain tub 46 and spin tub 48. Thus, the disadvantage of having the droplets 96 of highly concentrated liquid soap landing on particular garments in a wash load during subsequent operations of machine 10 is overcome.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described herein is to be interpreted as illustrative and not in a limiting sense.

What is claimed is:

1. A clothes washing machine comprising:

a cabinet;

tub means including a spin tub rotatably disposed within a stationary drain tub for processing a wash load in said cabinet;

an additive liquid dispensing means disposed in said cabinet for providing an injection of additive liquid into said wash load, said dispensing means including an electrical battery for serving as a source of direct current in the operation of said dispensing means; and said spin tub being rotated from a source of alternating current.

2. A clothes washing machine as set forth in claim 1 wherein said dispensing means includes a reservoir of additive liquid connected hydraulically to pumping means for drawing a quantity of the additive liquid from said reservoir and forcefully expelling it into said wash load.

3. A clothes washing machine as set forth in claim 2 wherein said pumping means includes a pump coupled to a motor which is connected through an electrical control means to said battery.

4. A clothes washing machine comprising:

a cabinet;

tub means including a spin tub rotatably disposed within a stationary drawing tub for processing a wash load in said cabinet;

an additive liquid dispensing means disposed in said cabinet for providing an injection of additive liquid into said wash load, said dispensing means including an electrical battery for serving as a source of direct current in the operation of said dispensing means and a reservoir of additive liquid connected hydraulically to pumping means for drawing a quantity of the additive liquid from said reservoir and forcefully expelling it into said wash load, said pumping means including a pump coupled to a motor which is connected through an electrical control means to said battery, wherein said battery comprises a rechargeable battery connected electrically to an output of trickle charge transformer means for storing electrical energy in said battery during off-duty intervals of said motor, said trickle charge transformer means having an input connected electrically to a source of alternating current.

5. A clothes washing machine as set forth in claim 4 wherein said pump is of the constant displacement type, and said electrical control means includes electrical timer means connected electrically to said rechargeable battery for energizing said motor a predetermined length of time.

6. A clothes washing machine as set forth in claim 5 wherein said electrical control means includes adjustment means for preselecting said quantity of additive liquid corresponding to said length of time said motor is energized.

7. A clothes washing machine as set forth in claim 6 wherein said additive liquid is liquid soap having a temperature sensitive viscosity.

* * * * *